US008066578B2

(12) United States Patent
Liggett

(10) Patent No.: US 8,066,578 B2
(45) **Date of Patent: *Nov. 29, 2011**

(54) CHALLENGE COURSE

(76) Inventor: James Liggett, Allegan, MI (US)

( * ) Notice: Subject to any disclaimer, the term of this patent is extended or adjusted under 35 U.S.C. 154(b) by 649 days.

This patent is subject to a terminal disclaimer.

(21) Appl. No.: 11/649,065

(22) Filed: Jan. 3, 2007

(65) Prior Publication Data

US 2007/0191123 A1 Aug. 16, 2007

Related U.S. Application Data

(63) Continuation-in-part of application No. 11/017,877, filed on Dec. 21, 2004, now Pat. No. 7,175,534.

(51) Int. Cl.
*A63G 31/00* (2006.01)
*A63G 1/00* (2006.01)

(52) U.S. Cl. ..... 472/136; 482/35

(58) Field of Classification Search ..... 472/14, 472/15, 49, 50, 136; 482/35–43; 182/36–39, 182/63–69; 104/87
See application file for complete search history.

(56) References Cited

U.S. PATENT DOCUMENTS 2,812,010 A * 11/1957 Abdallah ..... 482/69
4,930,598 A * 6/1990 Murrill et al. ..... 182/69.5
5,468,199 A 11/1995 Keeler et al.
5,667,461 A * 9/1997 Hall ..... 482/69
5,885,189 A 3/1999 Lane et al.
6,244,991 B1 * 6/2001 Bingham ..... 482/69
6,431,319 B1 * 8/2002 Myers et al. ..... 187/243
7,416,054 B2 * 8/2008 Liggett ..... 182/36

OTHER PUBLICATIONS www.spectrumsports.com; link under Rope-A-Phobia (printout enclosed), Mar. 8, 2004.

* cited by examiner

*Primary Examiner* — Kien Nguyen

(57) ABSTRACT

A challenge course (10) comprising a frame (20) having a substantially horizontally oriented track (120), a vertically oriented column (60) fixed to and extending downwardly from said substantially horizontally oriented track beam (30), said vertically oriented column (60) terminating in a bottom portion that is fixed to a substantially oriented foundation (40). The track (120) has a channel (150) therein in which a moveable member (360) slides. The track (120) has interchanges whereby the moveable member (360) can be moved in one of different directions. Descending downwardly from said moveable member (360) is a safety cable (350). The safety cable (350) extending downwardly to a safety harness (600). A further embodiment includes the challenge course (10) that can be deployed and re-deployed by hauling with a motor-vehicle. Further, a participant can be secured to the track (120) while still on the ground before ascending to the activity height.

6 Claims, 7 Drawing Sheets

CHALLENGE COURSE

RELATED APPLICATIONS

The present application is a Continuation-In-Part of U.S. patent application Ser. No. 11/017,877, filed on 21 Dec. 2004 now U.S. Pat. No. 7,175,534.

This present application claims priority from U.S. patent application Ser. No. 11/017,877, filed on 21 Dec. 2004.

FIELD OF THE INVENTION

This invention relates to an apparatus in which participants are challenged to walk or scale various obstacle while elevated above the ground, which can test the participant's skills such as confidence or group problem solving

BACKGROUND OF THE INVENTION

Challenge courses are structures that allow a person or team to challenge themselves by participating in various events such as walking along swinging ropes or planks, at elevated heights. These courses are also used to train military personnel. These courses are also used at recreational parks or other such centers that have go-carts and miniature golf.

The invention is a challenge course that is not required to be secured to the earth, although it can be utilized in such a manner.

There further exists a need for a challenge course in which the participant is secured to the safety cable before reaching the activity height, such as at the ground level.

The challenge course is not required to be secured directly to the earth. The challenge course can be moved and deployed at various locations. This can be done by being hauled by a motor vehicle.

Figure 1:
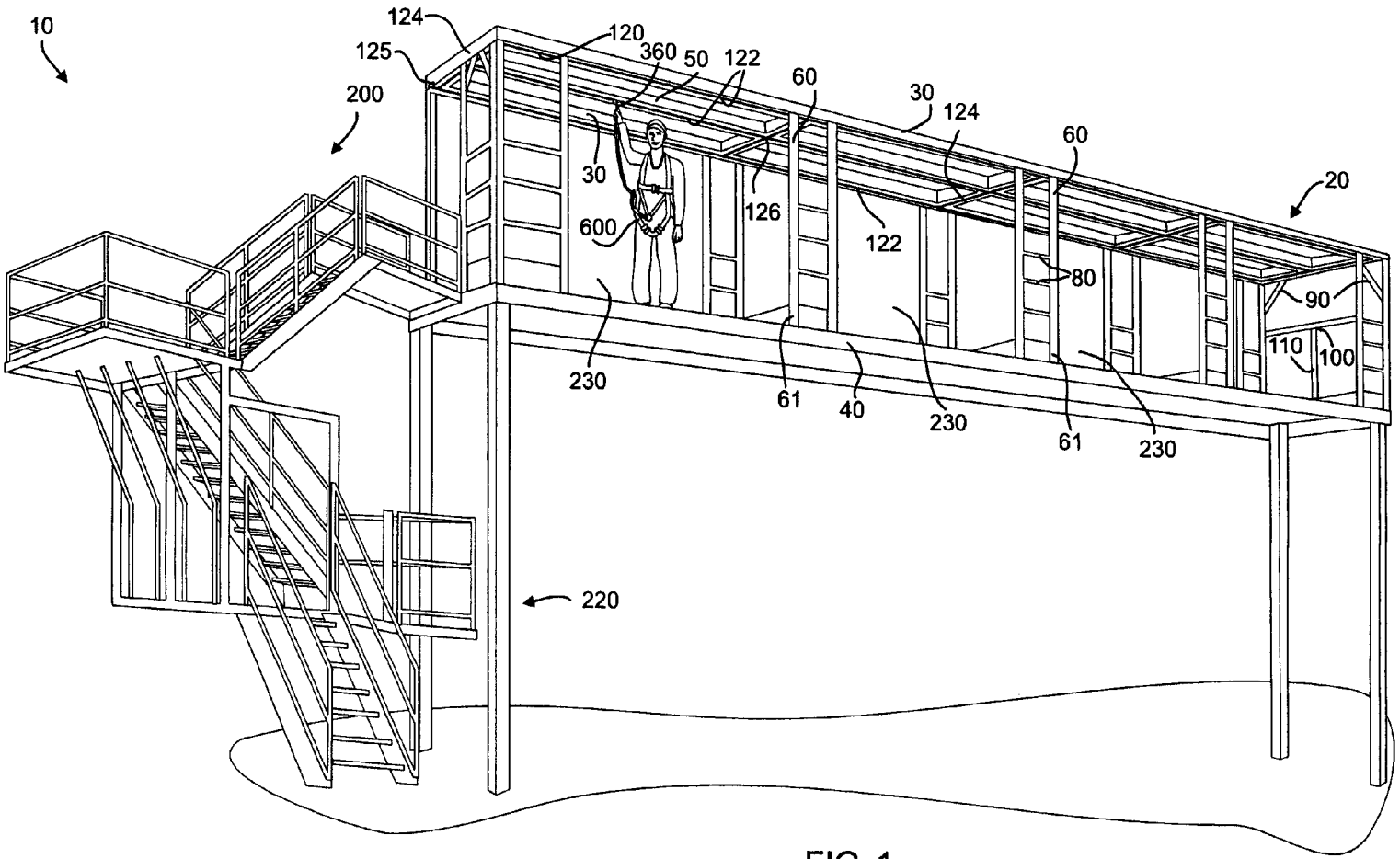
FIG. 1 is a pictorial view of a challenge course.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words.

REFERENCE NUMERALS USED IN THE DRAWINGS

10 challenge-course
20 frame
30 horizontally oriented beam
40 foundation

50 horizontally oriented center beam
60 vertically oriented-column
80 horizontal bar
90 cross brace
110 vertical support brace
120 track
122 lengthwise lane
124 widthwise lane
125 track slot
126 interchange
130 L-shaped member
132 L-shaped member horizontally oriented plate
134 L-shaped member vertically oriented plate
140 opening
150 channel
170 platform
180 widthwise lift support member
190 lengthwise lift support member
200 access means
220 access means
222 hinge mechanism
230 bay
240 standing platform
300 obstacle
350 safety cable
360 moveable member
370 locking member
400 biasing unit
500 trailer
510 trailer support deck
520 trailer support
525 vertically oriented legs
600 safety harness

DETAILED DESCRIPTION

Figure 3:
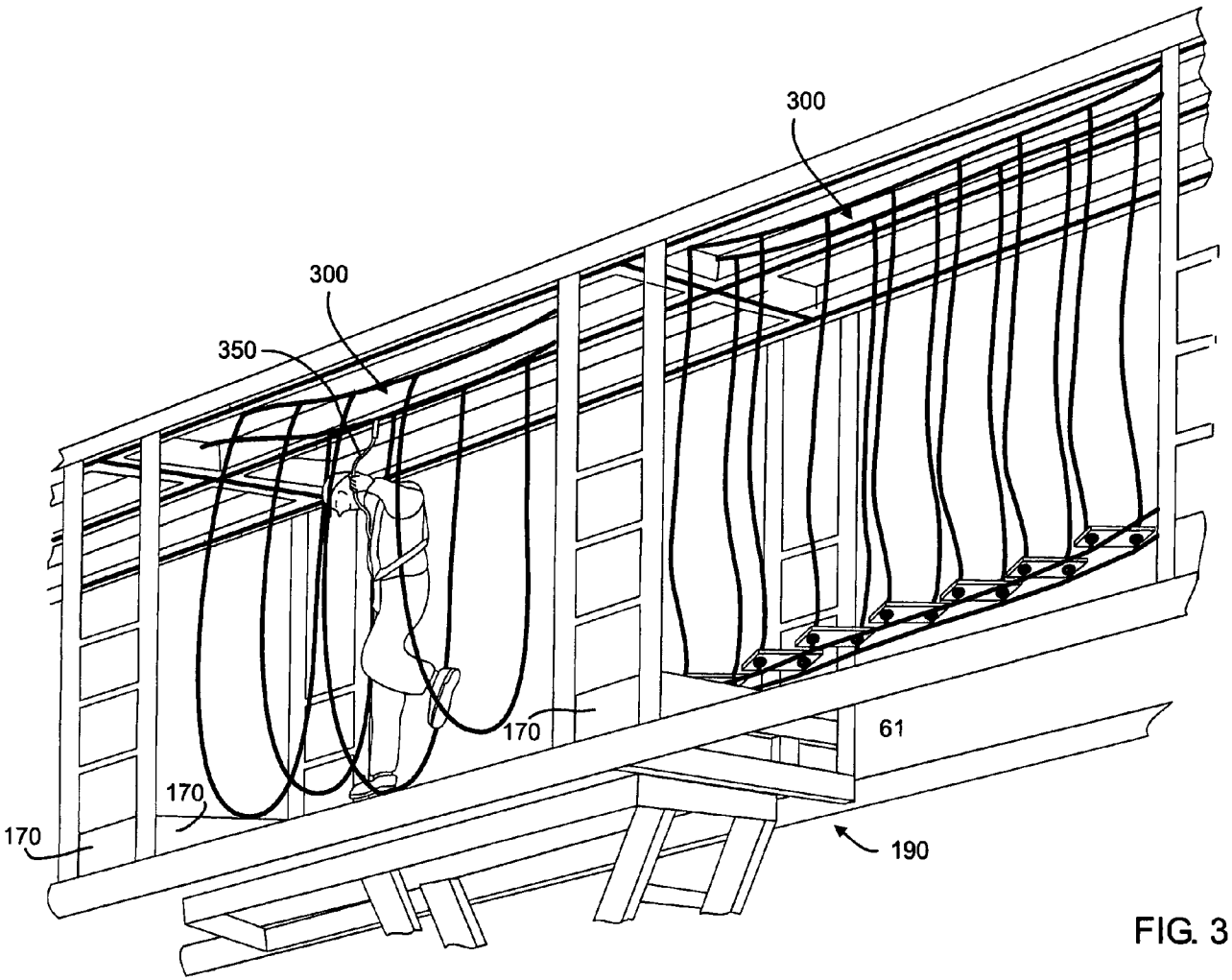
FIG. 3 is a second pictorial view of the challenge course.
Figure 4:
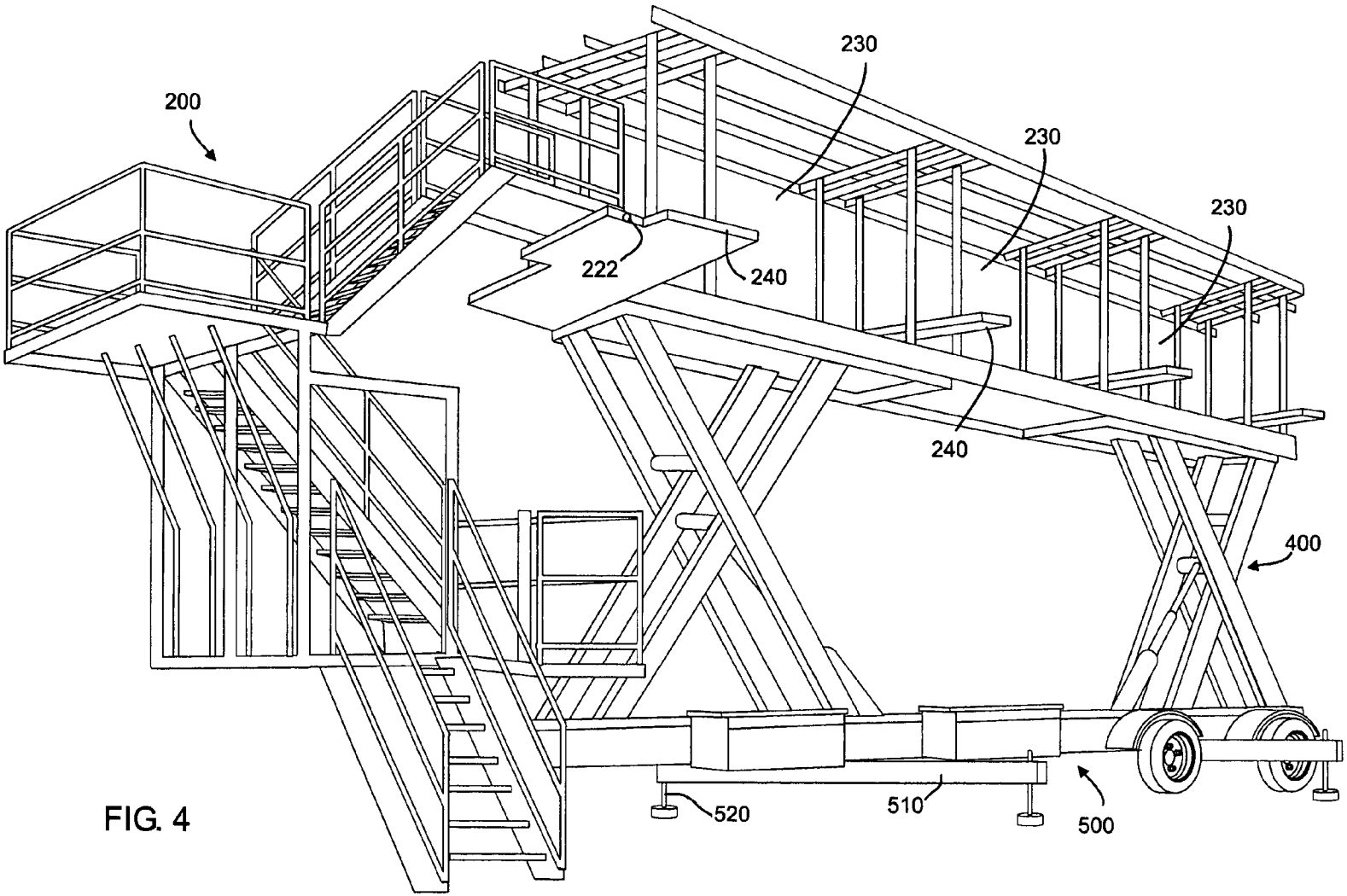
FIG. 4 is a third pictorial view of the challenge course.
Figure 6:
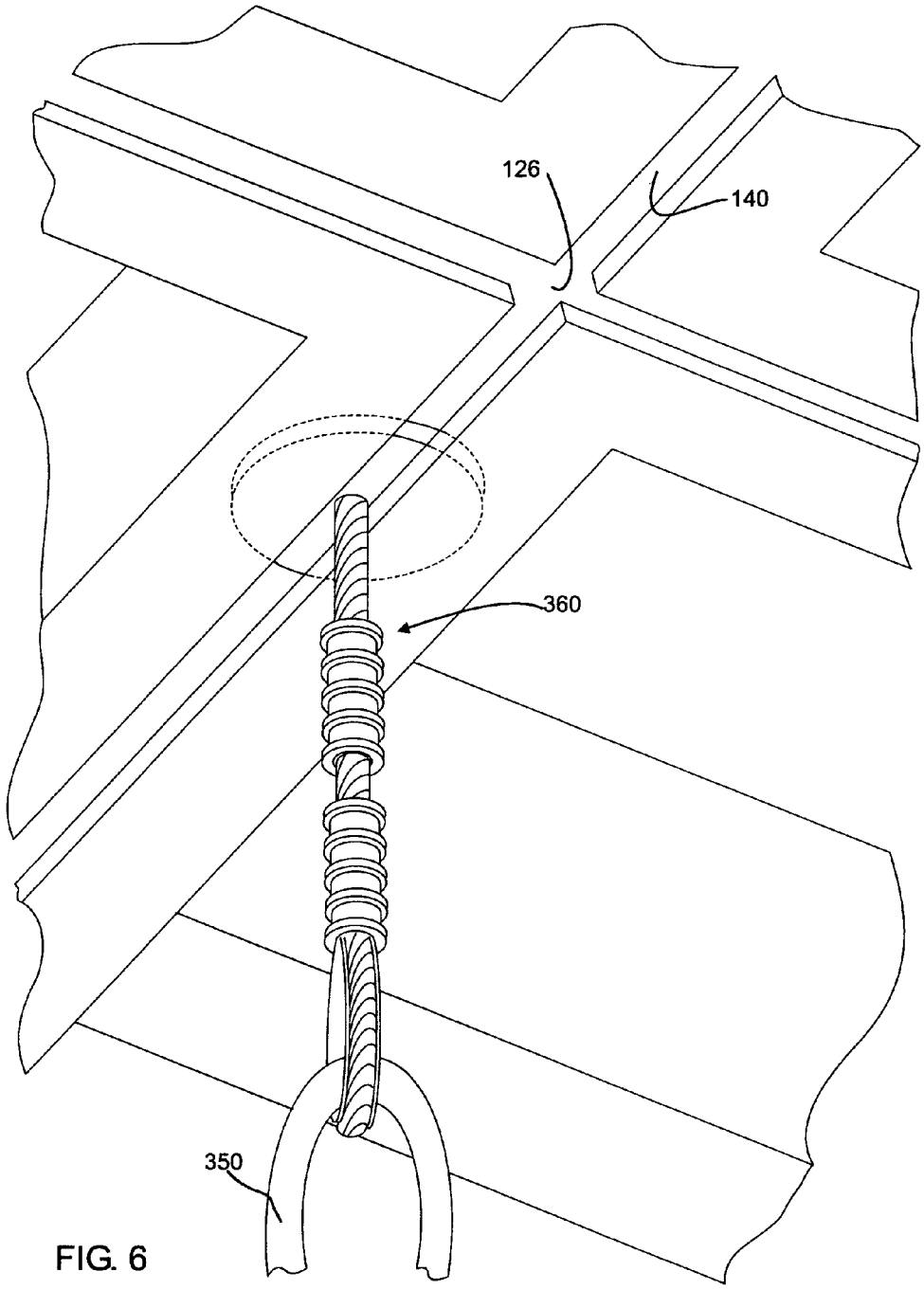
FIG. 6 is a first pictorial view of the safety cable secured in the tracking system.
Figure 8:
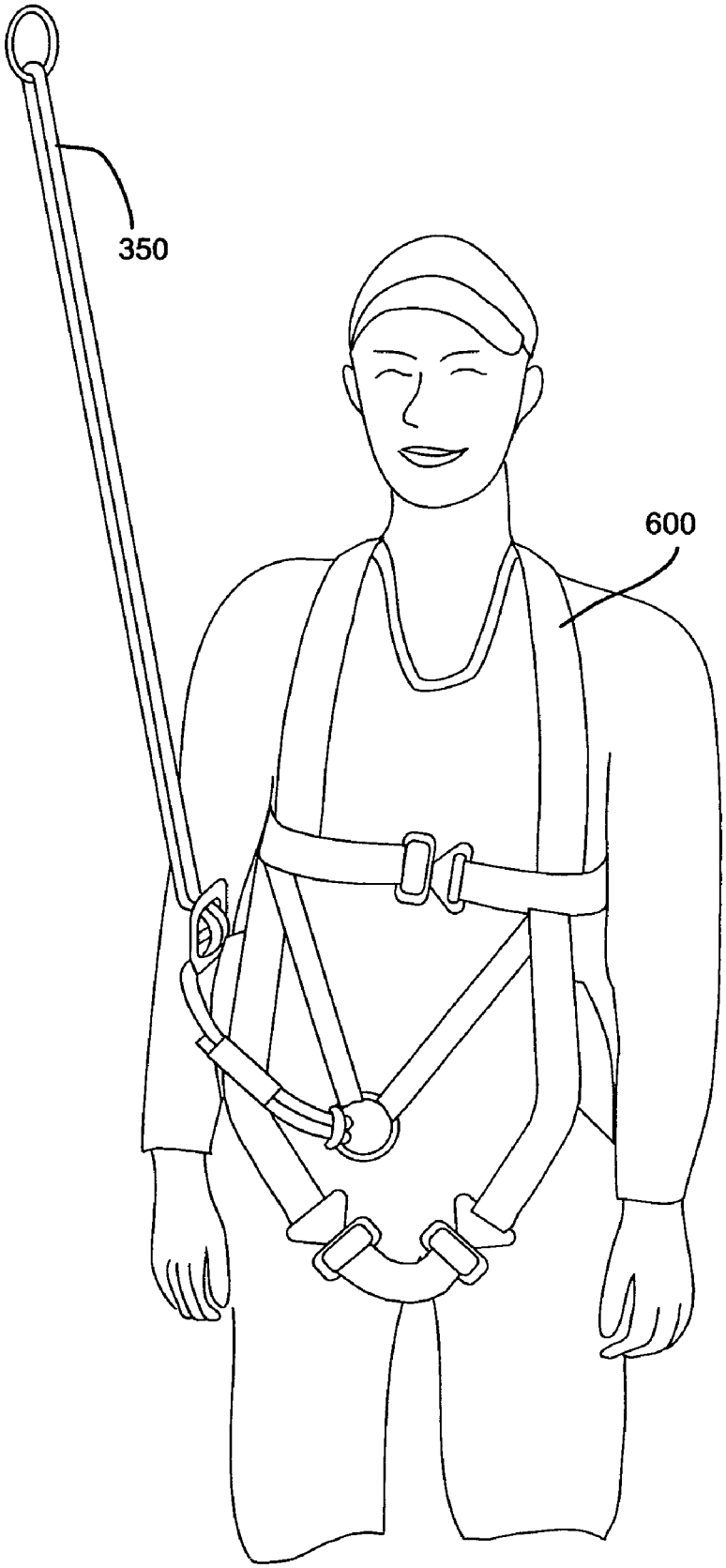
FIG. 8 is a pictorial view of a body harness.

FIG. 1 illustrates an embodiment of an apparatus for recreation, confidence building, group problem solving and team play on a challenge course 10. The challenge course 10 is constructed of a rigid frame 20 that is elevated above the ground. The participant walk on obstacle 300, as best shown in FIG. 3. The participants are secured to a harness cable 350, as best seen in FIGS. 3 and 6, via a body harness 600, as shown in FIG. 8. Participants enter from the ground level through an access means 220 to the frame 20. The ascending unit can be a stairway 200 as seen in FIG. 4. Although the figures show one access means 220, there can be more than one access means 220 connected to the frame 20.

The frame 20 has a substantially horizontally oriented track beam 30; a vertically oriented column 60 fixed to and extending downwardly from said substantially horizontally oriented track beam 30, said vertically oriented column 60 terminating in a bottom portion that is fixed to a substantially oriented foundation 40.

A horizontally oriented platform 170 is fixedly disposed to widthwisely opposed vertically oriented column 60 bottom portion 61.

An obstacle 300 is fixed at two ends between two lengthwisely adjacent bottom portions (61).

The track 120 integral with a horizontally oriented track beam 30, said track 120 adapted to receive safety cable throughout said track 120.

FIG. 1 displays a track 120 that has three lengthwise lanes 122, and five widthwise lanes 124. The obstacle 300 (best seen in FIG. 3) are separated by platforms 170 (best seen in FIG. 3), forming bays 230 (best seen in FIG. 4) there between.

The track 120 has an interchange 126 that enable the user to change direction and move from a lengthwise lane 122 to a widthwise lane 124. Although the lanes 122, 124 are shown to be parallel and perpendicular to one another, they can be curved, or serpentine shaped.

As the participant is traversing across the platforms 170 and obstacle 300, there is enough slack in the safety cable 350 causing no load on the track 120. In one embodiment, the maximum slack is about 12 inches.

Figures 5, 7:
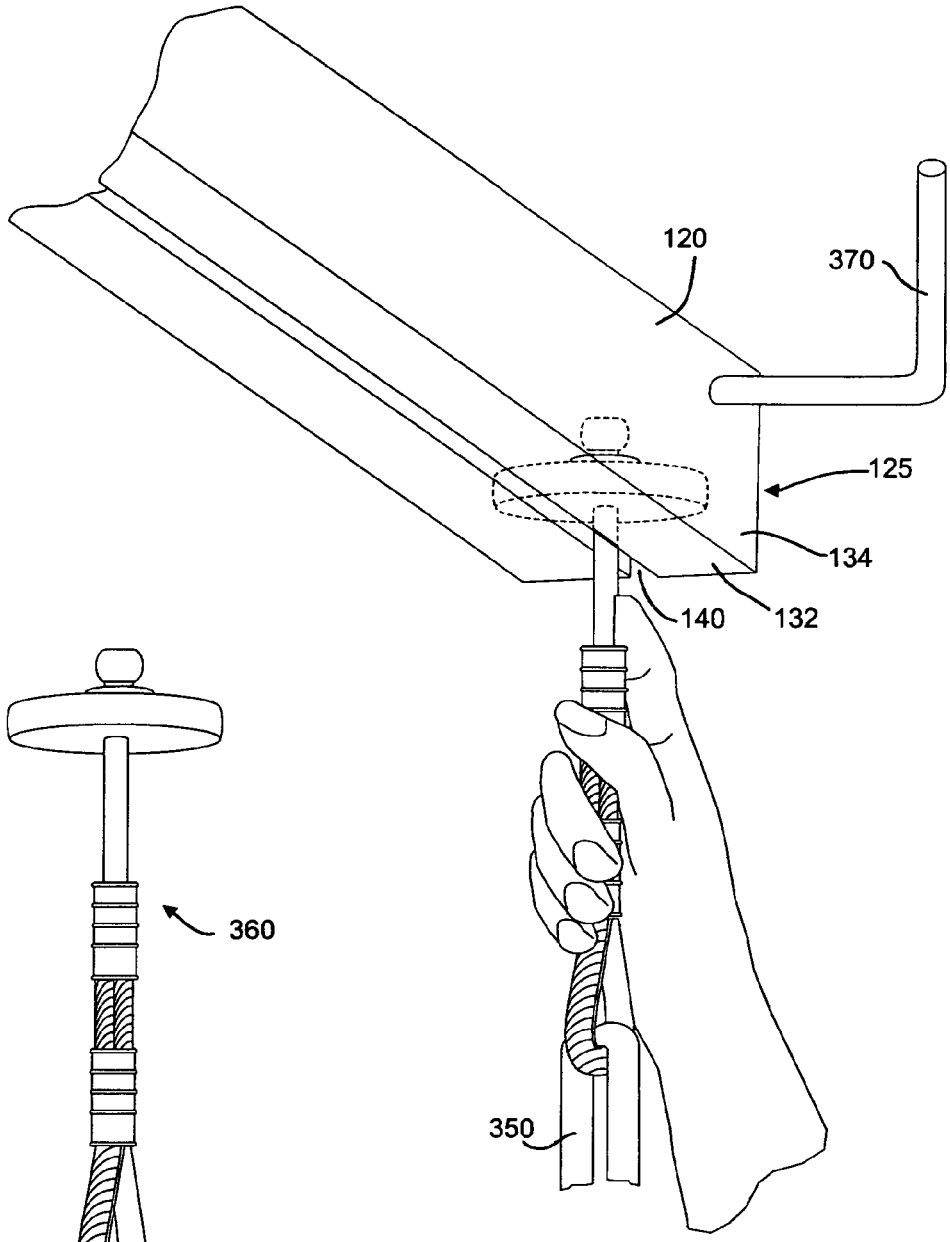
FIG. 5 is a pictorial view of a moveable member of a safety cable.
FIG. 7 is a second pictorial view of the safety cable secured in the tracking system.

As illustrated in FIG. 5, the safety cable 350 is secured to a moveable member 360. In one embodiment the moveable member 360 is made of the material known as UHMW. However other materials may be used. The UHMW provides for easy sliding along the track 120 due to the low friction forces. The moveable member 360 moves within the track 120.

Figure 2:
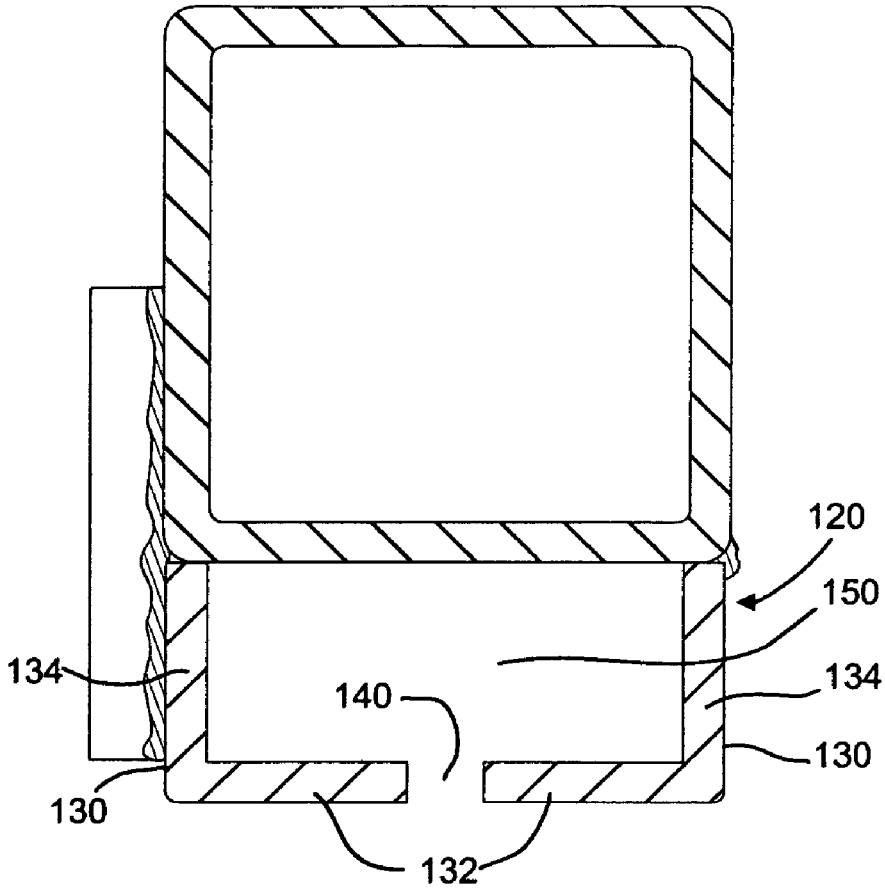
FIG. 2 is a sectional view of a track system of the challenge course.

As illustrated in FIG. 2, the track 120 is has two L-shaped members 130. The L-shaped member 130 has an L-shaped vertically oriented, portion 134, and a L-shaped member horizontally oriented portion 132, whereby the two opposed L-shaped members 130 form a channel 150 between two opposed L-shaped members 130. The two L-shaped member horizontally oriented portions 132 extend towards the opposed L-shaped member horizontally oriented, portion 132, so as to define an opening 140 there between. The opening 140 allows the safety cable 350 to descend from the moveable member 360 to the safety harness 600. Although the moveable member 360 contains the word member, this invention also teaches and suggests that the moveable member 360 is not required to be circular. The moveable member 360 can be any shape, such as square, triangular, or amorphous shaped.

FIG. 8 shows the safety harness 600, which is also known as a full-body harness because it secures the participant above the shoulders around the back of the neck, and between the legs. The safety harness 600 can be secured to the safety cable 350 in the front of the participant (as shown in FIG. 8), or in the back of the participant (not shown).

The moveable member 360 can enter and exit the channel 150 through a track slot 125, as shown in FIGS. 1 and 7. A locking member 370 prevents the moveable member 360 from inadvertently being removed from the channel 150.

In one embodiment, there is only one track slot 125 located near the ground, which is also near the bottom of the access means 220 (not shown). It is also at this location that the participant is secured in the safety harness 600. In this embodiment, the participant is secured relative to the track 120 from the moment they begin to ascend upwards from the ground, to the point of return at ground level.

The frame 20 of challenge course 10, the frame 20 is fabricated of components constituting steel-tubes, angle rods and connecting nipples, L's and T's which are readily available with low maintenance cost, reducing greatly the cost of production of the invention. In one embodiment the frame 20 a track 120 extends 53 feet in length and 8 feet in width and has three or more bays 230. A shorter version has two bays 230 (not shown). The two-bay 230 version would be convenient for hauling behind smaller vehicles, such as pick-up trucks.

In a further embodiment, the challenge course 10 is able to ascend and descend via a biasing unit 400. In this embodiment the challenge course 10 can be deployed and re-deployed. The challenge course 10 can be biasly disposed on a flat bed trailer. Then it can be driven to a location. At this location an access means 220 can be hingedly attached by a hinge member or hinge mechanism 222. Then the challenge course 10 can be biased upwardly via the biasing unit 400. Further, it can be moved from one location by another by a truck, as shown in FIG. 4. The challenge course 10 can be biased up and down while the access means 200 is attached, by means of a hinge mechanism 222 (as shown in FIG. 4). The access means 220 is removeably attached to the frame 20 near the hinge mechanism 222.

Some of the obstacle 300 are comprised of combination rope-cable. This provides for less displacement due the weight of the participant.

In accordance with the illustrative embodiment of the present invention an access means 220, such as a staircase (as shown in FIG. 1) is positioned at one end of the challenge course 10 to allow easy access to the challenge course 10. One or more biasing members 400, such as vertically extending scissor lifts placed on top of a trailer support deck 510 elevate the frame 20 of the challenge course 10 to a desired position, also known as the activity height. One embodiment has a desired activity height of 30 feet as measured from the ground to a bottom of the platform 40. The frame 20 can be extended vertically by means of a hydraulic cylinders and a retractable piston shaft fixedly attached at one end to the trailer support deck 510. A trailer support 520 extends vertically from the trailer support deck 510 to firmly hold the challenge course 10 to its position in resting phase.

In a further embodiment, in operation, at the start and end of each bay 230 are large platforms 240 for group congregation in team plays. In one embodiment, in which there are constructed three lengthwise parallel tracks 120, each platform 240 has three or more interchangeable elements 300 on the course 10 with total of nine or more obstacle.

The safety cable 350 is fastened to the overhead tracking system or track 120 and slides along with the user to each obstacle 300.

The bay 230 and track 120 configuration as shown in FIG. 1 allows for 12 varied obstacle 300 because three obstacle 300 can be disposed per bay 230, between adjacent platforms 170 under the three tracks 120 as shown in FIG. 1. Thus with five platforms 170, there is four bays 230, thus there could be a total of 12 different obstacle 300.

FIG. 4 shows an embodiment in which the challenge course 10 preferably includes a vehicle driven portable trailer 500, the surface of which forms a lift support deck 510. Placed below the deck 510 are retractable legs having four or more outer retractable legs and inner retractable legs with pedestal, extending horizontally below the surface on both sides of the deck, firmly anchoring the challenge course 10 to the earth.

FIG. 4 is a representation the trailer 500 having retractable legs 520 extending therefrom, terminating in a distal portion. The retractable legs 520 having vertically oriented legs 525 removeably secured to said distal portion to firmly secure the trailer 500 to the ground.

FIG. 5 show details of safety cable 350 and, the moveable member 360. In one embodiment the moveable member 360 is about ½ inch thick and has a diameter of about 2¾ inches. The moveable member 360 has a hole in the center to which a portion of the safety cable 350 is secured there through.

Although the invention has been described in terms of specific embodiment in the foregoing specification, however, the invention which intended to be protected is not to be construed as, limited to the particular embodiment disclosed any variation and modification that are equivalent in scope to the claims fall within the scope of the present invention.

I claim:

1. A challenge course (10) comprising:

a frame (20) having a track (120);

said track (120) adapted to receive a moveable member (360) and said track (120) having an intersection (126);

horizontally oriented platform (170) fixedly disposed to said frame (20);

an obstacle (300) secured to said frame (20), said obstacle (300) separated by said platform (170); and a safety cable (350) extending from said moveable member (360), whereby a person using the challenge course (10) can be connected to the safety cable (350).

2. The challenge course (10) of claim 1, further comprising:

a vertically oriented member (60) fixed to and extending downwardly from said substantially oriented track (120), said vertically oriented column (60) terminating in a bottom portion (61) that is fixed to a foundation (40).

3. The challenge course (10) of claim 1, further comprising:

said track (120) having a channel (150) adapted to slideably receive said moveable member (360).

4. The challenge course (10) of claim 1, wherein said challenge course (10) is able to ascend and descend via a biasing unit (400).

5. The challenge course (10) of claim 4, wherein said biasing unit (400) is a scissors lift.

6. The challenge course (10) of claim 1, wherein said frame comprises at least two substantially parallel tracks (120).

* * * * *